United States Patent [19]

Tomaka

[11] Patent Number: 4,800,820

[45] Date of Patent: Jan. 31, 1989

[54] SIDE SILL ARRANGEMENT FOR A GONDOLA-TYPE RAILROAD CAR

[75] Inventor: Jan Z. Tomaka, Mount Royal, Canada

[73] Assignee: Alcan International Limited, Montreal, Canada

[21] Appl. No.: 937,033

[22] Filed: Dec. 2, 1986

Related U.S. Application Data

[63] Continuation-in-part of Ser. No. 634,929, Jul. 27, 1984, abandoned.

[51] Int. Cl.[4] ..... B61D 17/00; B61D 7/00

[52] U.S. Cl. ..... 105/406.1; 105/418

[58] Field of Search ..... 105/406.1, 418, 413–417, 105/244, 409

[56] References Cited

U.S. PATENT DOCUMENTS

| | | | |
|---|---|---|---|
| 2,286,954 | 6/1942 | Clarke et al. | 105/418 |
| 3,641,943 | 2/1972 | O'Neill | 105/418 |
| 3,817,189 | 6/1974 | Bailey et al. | 105/406.1 |
| 4,024,821 | 5/1977 | Tang | 105/406.1 |
| 4,236,459 | 12/1980 | Troli | 105/406.1 |
| 4,301,742 | 11/1981 | Patil et al. | 105/406.1 |
| 4,348,962 | 9/1982 | Smith | 105/414 X |
| 4,633,787 | 1/1987 | Przybylinski et al. | 105/418 |
| 4,690,072 | 9/1987 | Wille et al. | 105/406.1 |

OTHER PUBLICATIONS

"Locomotives and Cars"—Feb. 1958—*Aluminum Center Sills Prove Themselves*, pp. 25, 26, 27, 36.

*Primary Examiner*—Robert B. Reeves
*Assistant Examiner*—Joseph D. Pape
*Attorney, Agent, or Firm*—Cooper & Dunham

[57] ABSTRACT

A center sill-less type gondola railroad car having an aluminum car body which includes an extra large load carrying compartment or container supported on a surrounding horizontal rectangular framework that consists essentially of a pair of transversely oriented shear plates at opposing ends of the car body, and a pair of parallel side sills which extend longitudinally between the shear plates and which are attached to the shear plates by special load transfer members, each of which members consists of two pairs of legs which extend radially from a common central juncture and which are designed to withstand the high stresses that peak at the spots where the members first contact the shear plates. The car body has a pair of oppositely disposed, upwardly curving side walls and a U-shaped, downwardly curving bottom portion which coact with a pair of stepped end walls to form the container which has an open top in spaced vertical relation above a closed bottom. The bottom portion of the container is secured to downwardly extending legs of the two load transfer members in spaced relation below a pair of V-shaped crotches which are formed by the legs and in which the side sills are secured. The side walls are fastened to the side sills in spaced relation above the juncture of the legs of each of the load transfer members.

18 Claims, 4 Drawing Sheets

SIDE SILL ARRANGEMENT FOR A GONDOLA-TYPE RAILROAD CAR

CROSS REFERENCE TO RELATED APPLICATION

The present application is a continuation-in-part of applicant's copending U.S. patent application, Ser. No. 634,929, filed July 27, 1984, now abandoned.

BACKGROUND OF THE INVENTION

The invention relates to railroad cars, especially load-carrying cars which are used in unit trains, where a number of similar cars are maintained together in coupled relation as a unit for hauling a specific material, such as coal.

In particular, the invention relates to center sill-less type hopper or gondola railroad cars, e.g. the gondola car which is shown and described in U.S. Pat. No. 3,817,189 as having a load-carrying car body which is made of aluminum (the term "aluminum," as employed herein, embracing aluminum-based alloys), rather than heavier weight steel, to radically reduce the weight of the car, so that the payload, carried by the car, can be substantially increased. The larger payload is accommodated by an enlarged gondola body which is secured between a surrounding framework, rather than atop a center sill which extends longitudinally and centrally of the car. The framework essentially consists of a pair of transversely oriented, flat shear plates and a connecting pair of parallel side sills which extend longitudinally of the car and which interact with the shear plates to transmit the push/pull forces, imposed on the car during operation, between the car coupling devices that are located adjacent the shear plates at opposing ends of the car.

It has been found that, in center sill-less car structures of this type, the coupler forces produce high stresses in the areas where the side sills join the shear plates. These stresses peak in the lower inboard corners of the side sills closest the center axis of the car and in the upper regions of the bottom portion which is welded to the side sills. Such peak stresses, which are superimposed on local geometric concentrations and discontinuities, such as the ends of the welds, are capable of causing in such areas, fatigue failures, such as cracking. The invention is directed to alleviating this problematic condition by the provision in such areas of a specially designed member which can better withstand the high peak stresses.

SUMMARY OF THE INVENTION

The present invention is broadly directed to the combination, in a center sill-less railroad car body, of two spaced, aligned shear plates extending transversely of the car body respectively adjacent opposite ends thereof; two spaced, parallel side sills extending between the shear plates longitudinally of the car body respectively along opposite sides thereof such that opposed end portions of each side sill are respectively adjacent longitudinal edges of the two shear plates and opposed longitudinal edges of each shear plate are respectively adjacent end portions of the two side sills; and means for interconnecting the side sill end portions to the respectively adjacent longitudinal edges of the shear plates to constitute a load-bearing frame for the car body such that longitudinally directed push-pull forces imposed on the car body during operation are primarily transmitted between the shear plates by the side sills. The term "longitudinal" as used herein to designate edges of a shear plate or other element is to be understood to refer to those edges (of the shear plate or other element) that extend longitudinally (i.e. lengthwise) of the railroad car body.

In accordance with the invention, and as a particular feature thereof, the interconnecting means comprises a plurality of unitary, integral load transfer members extending longitudinally of the car body and each having an X-shaped profile with a central juncture portion and four legs respectively extending radially inwardly, outwardly, upwardly, and downwardly therefrom. Each side sill end portion is received between, and secured to at least one of, the outwardly and upwardly extending legs of one of the load transfer members, while the inwardly extending leg of the same load transfer member is secured to and along the shear plate longitudinal edge adjacent the last-mentioned side sill end portion, such that longitudinal push/pull forces are transferred between the side sills and the shear plates through the load transfer members. The legs and juncture portions of the load transfer members each have a solid cross-section of dimensions sufficient to withstand stresses, created by the push-pull forces, which peak near locations where the members first contact the inside transverse edge of the shear plates. The junction portions, in particular, are the thickest portions of the load transfer members, and separate the localities at which a sill end portion and an adjacent shear plate edge are respectively secured to the load transfer member that interconnects them; i.e., the former and latter localities are respectively disposed outwardly and inwardly of the juncture portion that separates them. Conveniently, and very preferably, the load transfer members are secured to the side sill end portions and to the shear plate longitudinal edges by welds.

As used herein, the term "longitudinally" refers to the lengthwise dimension of the car, viz. the dimension in the direction in which the car normally moves along a railroad track. The terms "inwardly" or "inboard" and "outwardly" or "outboard" refer, respectively, to directions (transverse to the car) toward and away from the longitudinal center line of the car. These and other directional expressions (e.g., "horizontal," "vertical," "upwardly," and "downwardly") are all used with reference to the ordinary orientation of the car as it is moving, in upright position, along a horizontal track.

Briefly stated, in particular embodiments the invention is in a load-carrying railroad car which, when the car is in a horizontal position, comprises a pair of flat shear plates which are transversely oriented adjacent opposing ends of the car, and which are in horizontal alignment. A pair of side sills extend longitudinally between the plates in parallel relation and form with the shear plates a framework for supporting a container for holding the payload. The container is formed by a pair of side walls which extend upwardly from between the side sills, a U-shaped bottom portion which extends downwardly from between the side sills, and a pair of end walls which converge in a downward direction. At least one pair of special, load transfer members, each of which includes at least one pair of angularly disposed legs, are welded between the side sills and shear plates to absorb the peak stresses at such junctures. The U-shaped bottom portion of the container is also secured to the members, but at different locations from those at which the side sills are welded.

The use of the special load transfer members has many advantages. For example, they add improved resistance to metal fatigue without any significant increase in weight, and they add substantially greater sectional areas to withstand stresses in regions where it is desirable to reduce the peak stresses. Also, the legs of the members can be cut away to provide optimum geometric shapes to reduce stress concentrations. The peak stresses will occur in unwelded, smoothly cut material where there is maximum resistance to fatigue cracking. Very importantly, the connections of the members to the side sills and shear plates are easily welded by automatic machines, thereby avoiding stops and starts in the welds in areas of peak stresses, where such discontinuities are, oftentimes, the origin of fatigue cracking. Further, the longitudinal welds connecting the members and shear plates terminate at points which are far removed from the zones of maximum stress, as herebefore defined. Moreover, the large areas of contact between the side sills and members allow the optional use of metal bonding to supplement the welded connections, thus reducing stresses in the weld seams.

Further features and advantages of the invention will be apparent from the detailed description hereinbelow set forth, together with the accompanying drawings.

DETAILED DESCRIPTION

Figure 1:
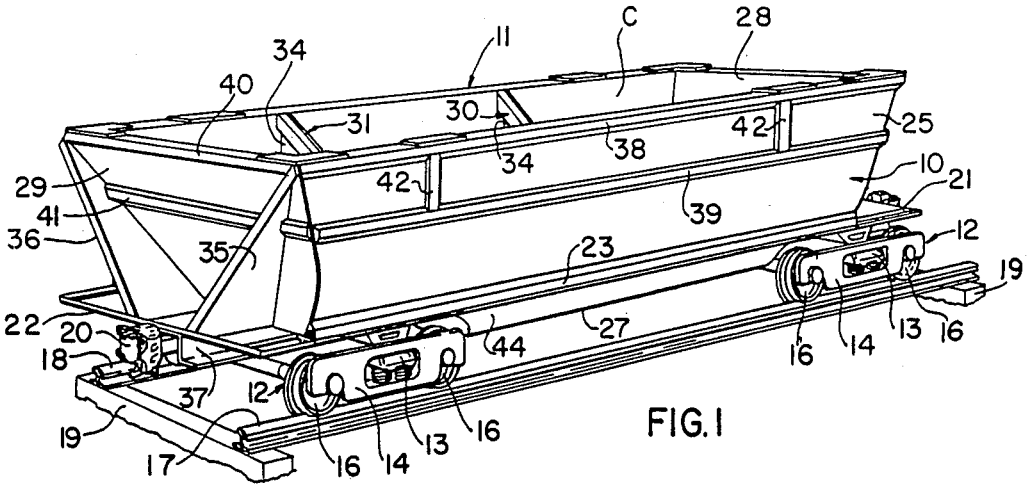
FIG. 1 is a perspective view of a gondola railroad car which is made in accordance with the invention.
Figure 2:
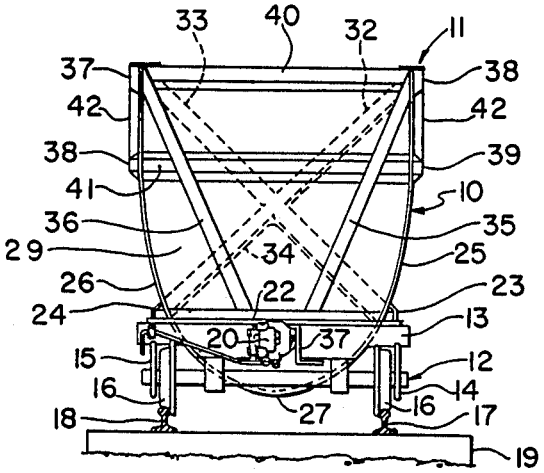
FIG. 2 is an end view of the gondola car.

With particular reference to FIGS. 1 and 2, there is shown, for example, a gondola-type railroad car 10 which essentially comprises an aluminum car body 11 that is mounted on a pair of conventional twin axle trucks 12, each of which includes a transversely oriented bolster 13 and attached side frames 14, 15 and wheels 16 that rollingly engage a pair of rails 17, 18 which are pinned in parallel relation to a number of parallel, wooden cross ties 19. Any suitable coupling device, e.g. a rotary drawbar or coupler 20 of the knuckle type, is used at each of the opposing ends of the car body 11 to rotatably attach the car to a similar, adjacent car of a unit train, for rotation about the coupler axis.

The car body 11, when in a horizontal position, comprises a pair of flat, rectangular shear plates 21, 22 which are transversely oriented at opposing ends of the car body 11 in horizontal alignment. A pair of any suitably shaped side sills 23, 24 extend longitudinally of the car body 11 between the shear plates 21, 22 in parallel relation. A pair of side walls 25, 26 extend in oppositely curving and diverging relation upwardly from between the side sills 23, 24 and terminate in vertically disposed, parallel relation. A curved bottom portion 27, having a generally U-shaped cross-sectional configuration, extends downwardly from between the side sills 23, 24. A pair of downwardly converging, longitudinally offset, stepped end walls 28, 29, including parts of the shear plates 21, 22 as the step portions, are welded to the opposing ends of the side walls 25, 26 and bottom portion 27 to form with them a load carrying compartment or container C which has an open top in vertical spaced relation above a closed bottom.

A pair of rigid bulkheads 30, 31, each of which includes a pair of X-shaped arms 32, 33 to which a butterfly-shaped plate 34 is attached, are optionally placed within the load-carrying container C and secured to the side walls 25, 26 to laterally brace the car body 11. A pair of triangularly-shaped stiffener plates 35, 36 are provided to brace each of the end walls 28, 29. They also act to brace a pair of similar, but oppositely disposed, stub sills 37 which are in parallel, longitudinal relation below each of the shear plates 21, 22 and to which the drawbars 20 and attached cushioning devices or draft gears are mounted. A number of horizontal and vertical reinforcing members 38–42 are provided to rigidify the side walls 25, 26 and end walls 28, 29 of the car body 11 and provide the car body 11 with rigid areas for engaging a rotary car dumper that is used to tip and rotate the individual cars 10 about their coupler axes to unload the cars, for example, when they are kept together as they pass through the dumper.

Figure 3:
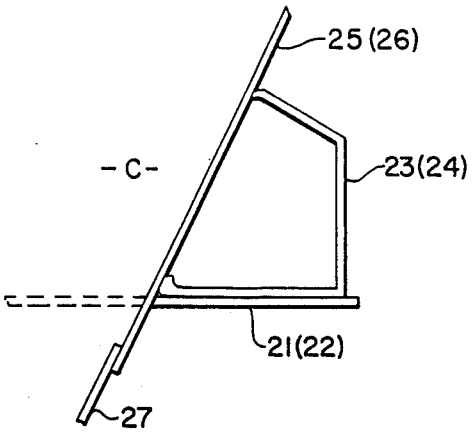
FIG. 3 (PRIOR ART)
FIG. 3 is an enlarged cross-section of a prior art junction of a side sill with adjacent edges of a side wall.

As best seen in FIG. 3, the adjacent edges of the side walls 25, 26 and curved bottom portion 27 of a car body of the prior art, are welded together in overlapped relation. Further, the generally C-shaped side sills 23, 24 are welded longitudinally of the side walls 25, 26 and extend atop the opposing edges of the shear plates 21, 22 to which they are also welded. The push/pull forces exerted upon the gondola car 10 during operation are transmitted between the drawbars 20 via the side sills 23, 24 and shear plates 21, 22. As previously indicated, the points where the side sills 23, 24 first join the shear plates 21, 22 are high stress areas susceptible to fatigue cracking. The other junctures between the side sills 23, 24 and the side walls 25, 26 are also lines of localized stress. The following described load transfer members 44 are designed to reduce and more readily withstand the high stress at such areas to eliminate or substantially reduce such fatigue cracking.

Figure 4:
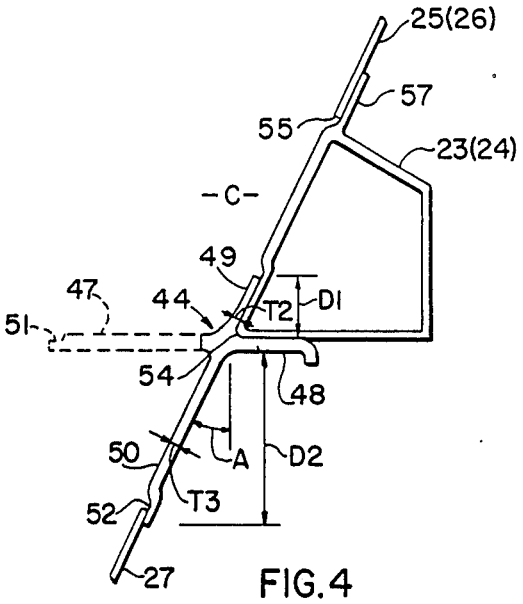
FIG. 4 is a similar section showing the use of the improved load transfer member, together with a modified hollow side sill for better withstanding the peak stresses, the section being taken in the area of the load-carrying compartment or container of the gondola car.
Figure 5:
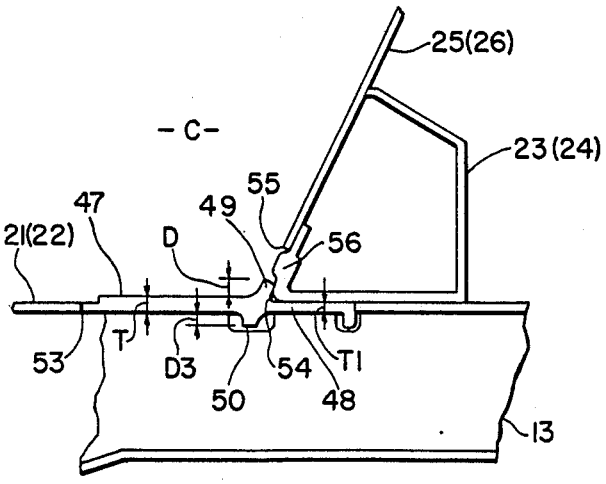
FIG. 5 is a similar section of the member, but with a different embodiment of a side sill, the section being taken in the area of the bolster which transmits the weight of the car body to a twin axle truck on which the car body is supported.
Figure 6:
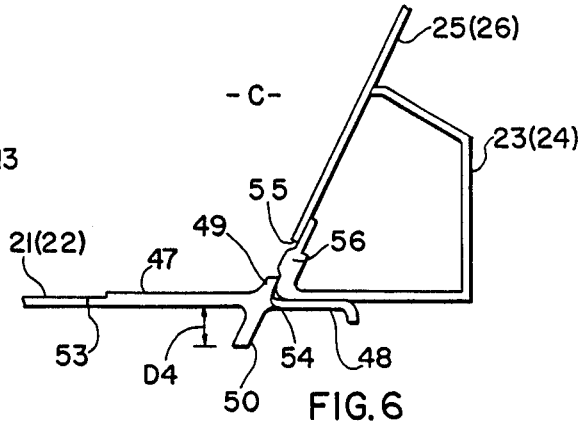
FIG. 6 is a similar section of the member with the side sill of FIG. 5, taken in the area of the shear plates away from the bolster.

With particular reference to FIGS. 4–6, there is shown a typical load transfer member 44 which is welded to the shear plates 21, 22 and each one of the side sills 23, 24. In contrast to the prior art, it is the load transfer members 44, and not the side sills 23, 24, which are welded to the shear plates 21, 22. The load transfer members 44 are also welded between the curved bottom portion 27 and the side sills 23, 24 and attached side walls 25, 26. The surfaces of the curved bottom portion 27, load transfer members 44, side sills 23, 24, and side walls 25, 26 exposed within the container C, are generally aligned in smooth contour relation, so as not to impede the dumping of material from the container C. The load transfer member 44 may extend substantially the full length of the car or it may extend only through the regions near the ends of the car where increased stresses occur.

Each of the load transfer members includes two pairs of legs 47–50 which intersect at a central juncture and extend radially therefrom to form a generally X-shaped cross-sectional configuration. The first pair of legs 47, 48 of an exemplary load transfer member 44 are horizontally disposed, whereas the second pair of legs 49, 50 are inclined from the vertical at an angle A of about 26–27 degrees. The radial orientation of the legs 47–50, relative to the central juncture, is naturally dependent on the shape of the car body 11, e.g. the shape of the side sills 23, 24 and the angular disposition of the adjacent side walls 25, 26. The first pair of horizontal legs 47, 48 has an inboard leg 47 which is closer to the center axis of the car 10 and has a thicness T of about ¾ inch, and an outboard leg 48 which is farther from the center axis and has a thickness T1 of about ½ inch. The inboard leg 47 (FIG. 4) is cut off or snubbed in the load-carrying compartment C of the car body 11, so as not to interfere with the loading or unloading of the material from the gondola car 10. The second pair of legs 49, 50 has a tapered leg 49 which extends vertically above the horizontal legs 47, 48 a distance D, D1 of from 1½ to 4½ inches, depending on whether the side sills 23, 24 have the unitary hollow structure of FIG. 4, or the C-shape of FIGS. 5 and 6. The tapered leg 49 tapers upwardly from 1 to ½ inches, having an average thickness T2 of about ¾ inch in a highly stressed area of the car body 11. The second pair of legs 49, 50 has a second leg 50 which extends downwardly below the horizontal legs 47, 48 a distance D2 of about 9½ inches. The downwardly extending leg 50 has a thickness T3 of about 11/16 inches. The inboard leg 47 and the downwardly extending leg 50 have offset ledges 51, 52.

The downwardly extending leg 50 is cut off or snubbed in the areas of the bolsters 13 (FIG. 5) and the shear plates 21, 22 (FIG. 6), but at different lengths. For example, the downwardly extending leg 50 is cut off or snubbed in the region of the trucks 12, at a distance D3 of about 1¼ inches below the horizontal legs 47, 48. The adjacent bolsters 13 are notched to receive the snubbed leg 50. In the areas of the shear plates 21, 22, the downwardly extending leg 50 is cut off a distance D4 of about 3 inches below the horizontal legs 47, 48. Cuts in legs 47, 50 may be contoured to reduce stress concentrations.

The shear plates 21, 22 are welded to the innermost edges or tips 53 of the inboard legs 47, as best seen in FIGS. 5 and 6. The side sills 23, 24 and attached side walls 25, 26 are welded in the V-shaped crotches 54 that are formed between the outboard legs 48 and the upwardly extending legs 49. The curved bottom portion 27 is welded in the offset ledges 52 that are formed in the downwardly extending legs 50. The load transfer members 44 have heavier legs 47–50 to withstand the peak stresses which are imposed upon them at the most stressful junctures of the side sills 23, 24 with the shear plates 21, 22.

The unitary hollow structure of the side sills of FIG. 4 is preferred to the C-shaped structure of FIG. 5, wherein the lower edges 55 of the sidewalls 25, 26 and the upwardly tapered legs 49 are secured to upwardly extending flanges 56 of the side sills 23, 24 in, practically, abutting relation. The unitary hollow side sills 23, 24 of FIG. 4 are likewise provided with upturned flanges 57, but at the upper and not lower extremities of the side sills 23, 24, to which the lower edges 55 of the side walls 25, 26 are secured in farther spaced relation from the upwardly tapered legs 49.

Thus, there has been described a highly improved design for eliminating or substantially reducing fatigue cracking at junctures where peak stresses occur. This is accomplished by the use of the special load transfer members 44 with the crossed legs 47–50 which are designed to withstand the stresses imposed upon them far better than the much thinner sheet or plate metal material of which the sidewalls and side sills are composed.

As shown in FIGS. 4–6, each of the load transfer members 44 is a unitary, integral member of X-shaped profile having four legs extending radially respectively inwardly, outwardly, upwardly and downwardly from a central juncture portion which is thicker than any of the legs and which separates the respective localities at which a side sill end portion and an adjacent shear plate longitudinal edge are secured to the load transfer member, such that the former and latter localities are respectively disposed outwardly and inwardly of the juncture portion. In specific embodiments of the invention, wherein the railroad car body is fabricated of aluminum, each of the members 44 is an aluminum extrusion, constituted (for example) of the alloy having the Aluminum Association designation AA 6351, in T6 temper.

FIGS. 7–13 illustrate a currently preferred embodiment of the invention, incorporated in a center sill-less, gondola-type railroad car 110 having an aluminum car body 111 mounted on a pair of conventional wheel-bearing trucks 112. In this car body, a pair of shear plates 121, 122 extend transversely of the body, in spaced and aligned relation to each other, respectively adjacent opposite ends of the body, while a pair of side sills 123, 124 extend longitudinally of the body and respectively on opposite sides of the body, in spaced parallel relation to each other, between the shear plates. The body also includes a pair of planar vertical side walls 125, 126, extending upwardly from the side sills; a curved, U-shaped bottom portion 127, extending downwardly from and between the side sills; and a pair of stepped end walls 128, 129, including parts of the shear plates as the step portions, welded to the side walls and bottom portion to constitute therewith an upwardly opening container C′ for carrying a load of material to be transported by the car. Generally as described above with reference to the car of FIG. 1, bulkheads 130, 131 and other bracing and/or reinforcing elements are also included in the car body 111, for the usual purposes.

Figure 11:
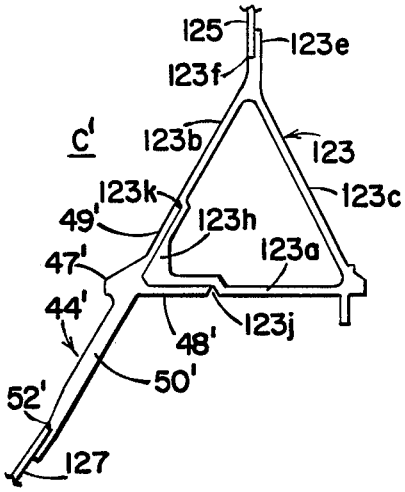
FIG. 11 is a further enlarged fragmentary sectional elevational view taken as along line 11—11 of FIG. 8.
Figure 12:
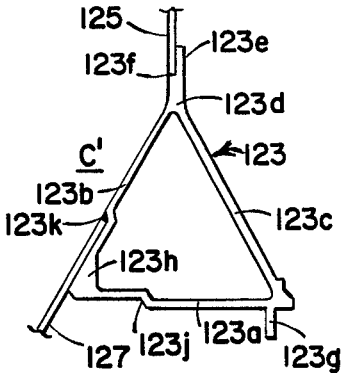
FIG. 12 is a similar sectional view taken as along line 12—12 of FIG. 8.
Figure 10:
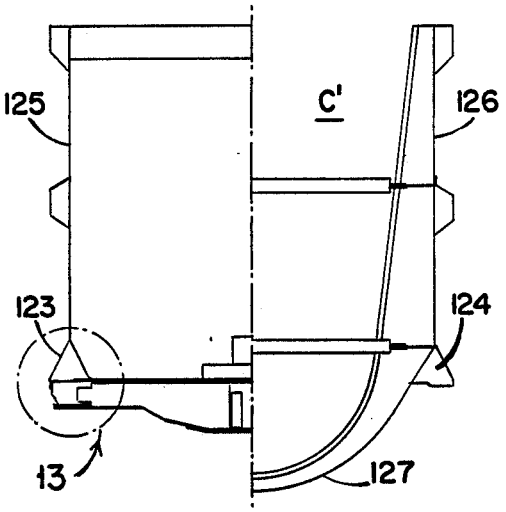
FIG. 10 is a similarly enlarged sectional elevational view of the railroad car of FIG. 7, taken as along the line 10—10 of FIG. 7.
Figure 13:
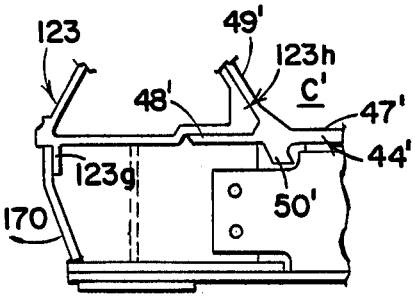
FIG. 13 is a similarly enlarged detail view of the region indicated by circle 13 in FIG. 10.

As best seen in FIGS. 11 and 12, the side sill 123 (to which the side sill 124 is identical) is a hollow member with an isosceles-triangle profile, e.g. an aluminum extruded member, having a bottom wall **123*a* and side walls 123*b* and 123*c* respectively extending upwardly from the inner and outer margins of the bottom wall to a vertex 123*d*. A vertical leg 123*e* projects upwardly from the vertex and has an offset ledge 123*f*, while a second, short vertical leg 123g projects downwardly from the bottom wall 123a adjacent the outer margin thereof, providing a mount for a body bolster reinforcing element 170 (FIG. 13). The bottom wall 123a and the inner side wall 123b cooperatively define an acute included angle, with an apex 123h at which the sill member is thickened; offset ledges 123j and 123k are respectively formed on the exposed surfaces of these two walls adjacent the apex 123h**.

In the car body 111, the end portions of the side sills 123 and 124 are connected to the respectively adjacent longitudinal edges of the shear plates 121 and 122 by load transfer members 44' which are aluminum extrusions essentially identical to the load transfer members 44 shown in FIGS. 4–6 above, except for minor differences in the location and/or extent of cutting or snubbing of the legs. Four such members 44' are included in the car body 111, one at each corner of the load-bearing frame constituted by the side sills and shear plates. Each member 44' extends only partway along the length of the car body.

Specifically, each member 44' has an inwardly extending horizontal leg 47' to which a shear plate longitudinal edge is weldedly secured; an outwardly extending horizontal leg 48' and an upwardly extending leg 49' between which a side sill end portion is received (and welded to the load transfer member); and a downwardly extending leg 50' having an offset ledge 52'. Legs 48' and 49' define an included angle equal to that between walls 123a and 123b of the side sill member 123; hence, when the side sill end portion is received between (and weldedly secured to at least one of) the latter legs, these side sill walls are respectively parallel and contiguous to the legs.

At those portions of the car length along which the load transfer members 44' extend, the upper longitudinal edges of the car body bottom portion 127 are welded to the downwardly extending legs 50' of the members 44', being accommodated within the offset ledges 52 thereof, while the offset ledges 123j and 123k in the side sill walls 123a and 123b, respectively, accommodate the load transfer member legs 48' and 49'. Intermediate the members 44', the upper longitudinal edges of the bottom portion 127 are welded directly to the side sills, being accommodated in the offset ledge portion 123k (and the corresponding offset ledge portion of sill 124). The lower longitudinal edge of side wall 25 is welded to the side sill leg 123e along its full length, and is accommodated within the offset ledge portion 123f thereof. As in the embodiment of FIGS. 4–6, the offset ledge portions provide a smooth internal contour for the container C' so as not to impede discharge of material therefrom.

Figure 7:
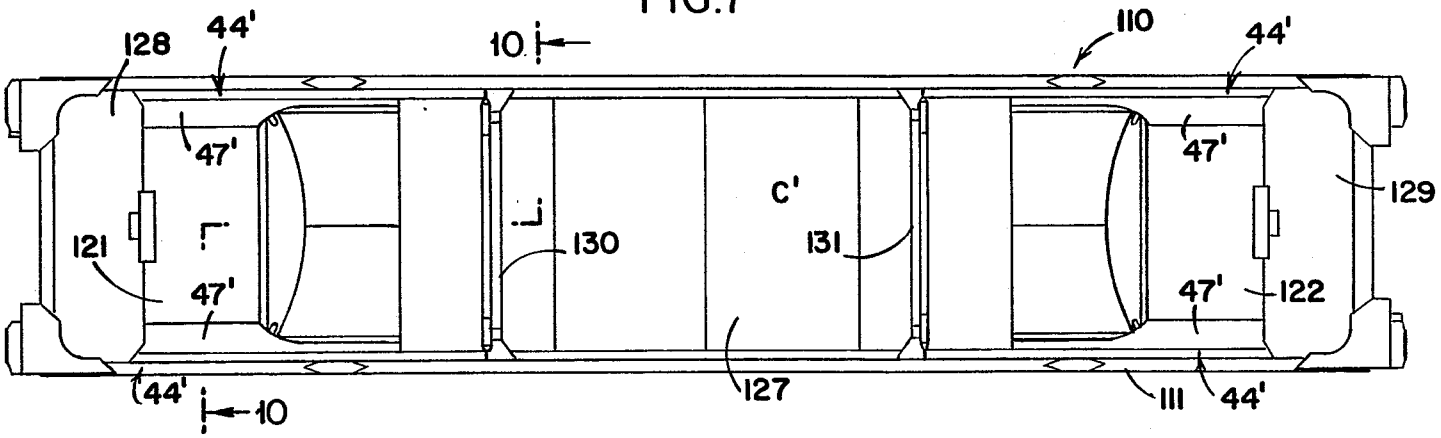
FIG. 7 is a plan view of a railroad car incorporating a currently preferred embodiment of the invention.
Figure 8:
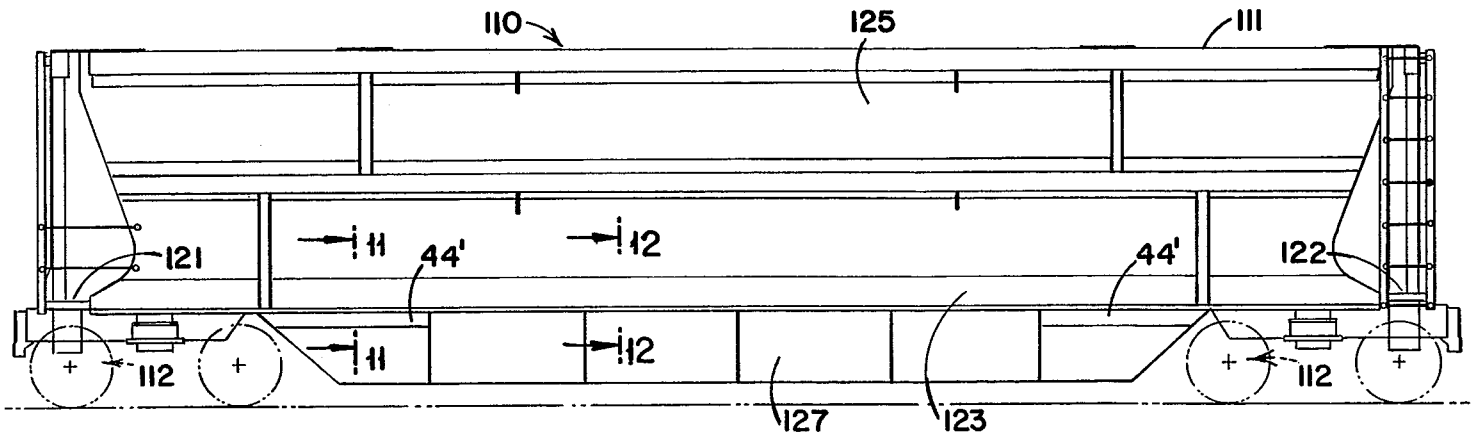
FIG. 8 is a side elevational view of the railroad car of FIG. 7.
Figure 9:
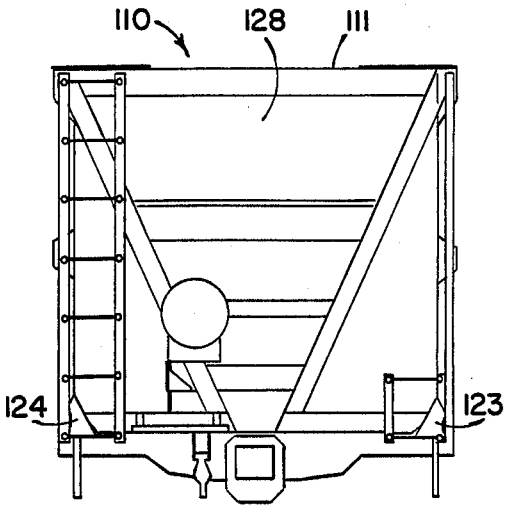
FIG. 9 is an enlarged end elevational view of the railroad car of FIG. 7.

FIG. 7 shows that the legs 47' of the load transfer members 44' are snubbed or cut away, and as illustrated, these cuts are so contoured (viz. with smooth, gentle curves) as to minimize stress concentrations.

In the car of FIGS. 7–13, the triangular side sill with its thickened inner corner 123h contributes to the overall strength and durability of the load-bearing and push-/pull force-transmitting structure, cooperating in these respects with the special load transfer members 44'. The embodiment of FIGS. 7–13 is also illustrative of the application of the invention to a car having vertical side walls.

It is to be understood that the invention is not limited to the features and embodiments hereinabove specifically set forth, but may be carried out in other ways without departure from its spirit.

I claim:

1. In a center sill-less railroad car body, in combination, (a) two spaced, aligned shear plates extending transversely of the car body respectively adjacent opposite ends thereof;

(b) two spaced, parallel side sills extending between the shear plates longitudinally of the car body respectively along opposite sides thereof such that opposed end portions of each side sill are respectively adjacent longitudinal edges of the two shear plates, and opposed longitudinal edges of each shear plate are respectively adjacent end portions of the two side sills; and (c) means for interconnecting the side sill end portions to the respectively adjacent longitudinal edges of the shear plates to constituted a load-bearing frame for the car body such that longitudinally directed push-pull forces imposed on the car body during operation are primarily transmitted between the shear plates by the side sills;

(d) the interconnecting means comprising a plurality of unitary, integral load transfer members extending longitudinally of the car body and each having an X-shaped profile with a central juncture portion and four legs respectively extending radially inwardly, outwardly, upwardly, and downwardly therefrom;

(e) each side sill end portion being received between, and secured to at least one of, the outwardly and upwardly extending legs of one of the load transfer members, and the inwardly extending leg of the same load transfer member being secured to and along the shear plate longitudinal edge adjacent the side sill end portion which is received between the outwardly and upwardly extending legs of the same load transfer member, such that longitudinal push-pull forces are transferred between the side sills and the shear plates through the load transfer members, and each load transfer member forms an integral portion of the exposed surface of the interior of the car body;

(f) the legs and juncture portions of the load transfer members each having a solid cross-section of thickness sufficient to withstand stresses, created by the push-pull forces, which peak near locations where the members first contact the inside transverse edge of the shear plates.

2. A car body as defined in claim 1, wherein the load transfer members are secured to the side sill end portions and to the shear plate longitudinal edges by welds.

3. A car body as defined in claim 2, wherein each side sill has a bottom wall and a side wall projecting upwardly from the inner margin of the bottom wall and defining therewith an included angle such that the bottom wall and the side wall of each side sill end portion are respectively parallel to the outwardly and upwardly projecting legs of each load transfer member in which the end portion is received.

4. A car body as defined in claim 3, wherein said inwardly and outwardly extending legs are opposed horizontal legs, and wherein said upwardly and downwardly extending legs are opposed to each other and so oriented that the upwardly and outwardly extending legs define an acute included angle.

5. A car body as defined in claim 4, wherein each side sill has a hollow triangular profile.

6. A car body as defined in claim 2, further including a pair of side walls which extend longitudinally of the car body and which are secured to, and extend upwardly from, the side sills; a bottom portion which extends downwardly from the side sills; and a pair of end walls closing opposed open ends of the side walls and bottom portion for forming therewith a load-carrying container; and wherein said bottom portion has longitudinal edge portions secured to the downwardly extending legs of the load transfer members.

7. A car body as defined in claim 6, wherein the inwardly extending legs of the load transfer members are cut off and snubbed in the container so as not to interfere with loading and unloading of material from the container.

8. A car body as defined in claim 7, wherein the downwardly extending legs of the load transfer members are cut off and snubbed to provide clearance for trucks and bolsters for supporting the car body.

9. A car body as defined in claim 8, wherein the downwardly extending leg of each load transfer member includes, at its lowermost edge, an offset ledge against which an adjacent longitudinal edge portion of the bottom portion is secured, the offset of the ledge being such that the adjacent surfaces of the bottom portion and load transfer member legs are in smooth-contour relation so as not to impede discharge of material from the container.

10. A car body as defined in claim 9, wherein the container has an open top in vertically spaced relation above a closed bottom, and the sidewalls extend upwardly from the side sills in oppositely curving relation and terminate in parallel relation, and the bottom portion is curved and has a generally U-shaped cross-sectional configuration, and the endwalls are stepped, having offset portions which converge downwardly from the open top of the container, the offset portions of each endwall being connected by a step portion which is part of an adjacent shear plate.

11. A car body as defined in claim 10, which includes a pair of rigid bulkheads disposed transversely within the container and secured to the adjacent sidewalls to brace the car body laterally, the bulkheads each including a pair of crossed arms, said crossed arms having an X-shaped cross-sectional configuration, and a butterfly-shaped plate that is secured to the crossed arms, such that material in the curved bottom portion is free to pass under the bulkhead.

12. A car body as defined in claim 11, which includes means adjacent the shear plates for removably coupling the car body to an adjacent car body of similar design.

13. A car body as defined in claim 12, which includes means adjacent opposing ends of the car body for mounting the car body for rolling engagement along a trackway.

14. A car body as defined in claim 9, wherein said side walls are substantially planar and vertical above the side sills, and wherein said bottom portion is curved with a generally U-shaped cross-sectional configuration extending downwardly from the side sills, each of said load transfer members extending only partway along the length of the car body, and the bottom portion having longitudinal edge portions secured to the side sills between the load transfer members.

15. A car body as defined in claim 9, wherein each of the side sills is C-shaped and has a longitudinal opening facing inwardly of the container, said longitudinal opening being closed by the adjacent sidewall, and said adjacent sidewall being secured to the side sill in closely spaced, generally aligned relation with the upper leg of an adjacent load transfer member.

16. A car body as defined in claim 9, wherein each side sill is an integral hollow structure with an upturned flange which extends upwardly and longitudinally of the side sill, an adjacent side wall being secured to the upturned flange such that adjacent surfaces of the curved bottom portion, load transfer member legs, and side wall, exposed within the container, are aligned in smooth contour relation such that the dumping of material from the container is not impeded.

17. A car body as defined in claim 1, wherein each of said load transfer members is an extruded member.

18. A car body as defined in claim 1, wherein said car body is an aluminum car body, and wherein said load transfer members are aluminum extrusions.

* * * * *